US007216583B2

(12) United States Patent
Schaede

(10) Patent No.: US 7,216,583 B2
(45) Date of Patent: May 15, 2007

(54) NUMBERING PROCESS AND NUMBERING BOX TO CARRY OUT THE PROCESS

(75) Inventor: Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 10/524,337

(22) PCT Filed: Aug. 12, 2003

(86) PCT No.: PCT/IB03/03652

§ 371 (c)(1),
(2), (4) Date: Aug. 25, 2005

(87) PCT Pub. No.: WO2004/016433

PCT Pub. Date: Feb. 26, 2004

(65) Prior Publication Data

US 2006/0162585 A1 Jul. 27, 2006

(30) Foreign Application Priority Data

Aug. 16, 2002 (EP) ..... 02405699

(51) Int. Cl.
*B41K 3/12* (2006.01)
*B41L 45/00* (2006.01)

(52) U.S. Cl. ..... 101/76; 101/93.01; 101/77; 101/79

(58) Field of Classification Search ..... 101/76, 101/77, 93.01, 79
See application file for complete search history.

(56) References Cited

U.S. PATENT DOCUMENTS

| | | | | |
|---|---|---|---|---|
| 1,503,375 | A | 7/1924 | Pendergast | |
| 1,650,535 | A | 11/1927 | Parsons | |
| 1,653,765 | A | 12/1927 | Hart | |
| 3,421,752 | A | 1/1969 | Folino | |
| 4,045,944 | A * | 9/1977 | Giori | 53/520 |
| 4,207,814 | A * | 6/1980 | Schenk | 101/76 |
| 4,677,910 | A | 7/1987 | Kuhfuss | |
| 5,660,106 | A | 8/1997 | Pitz et al. | |
| 6,647,402 | B1 * | 11/2003 | Chiu | 708/250 |

FOREIGN PATENT DOCUMENTS

EP 0 598 679 A1 5/1994

* cited by examiner

*Primary Examiner*—Daniel J. Colilla
*Assistant Examiner*—Marissa Ferguson-Samreth
(74) *Attorney, Agent, or Firm*—Crompton, Seager & Tufte, LLC

(57) ABSTRACT

The numbering box for typographic numbering in sheet or web fed printing machines, said box numbering with p digits k*n items on said sheets or web for allowing a sequential collecting of said items in the finishing and collating process of layers of q sheets or of web cut into layers of q sheets, wherein said box carries out a purely sequential actuation for digits 1 to s, where 10S is smaller or equal to q, a purely individually settable actuation for digits s+1 to r, where the maximum number printable by digits 1 to s and s+1 to r is smaller or equal to k*n*q, and a sequential actuation for digits r+1 to p.

16 Claims, 13 Drawing Sheets

| | | | |
|---|---|---|---|
| j=8 i=1<br><br>000 07 99 | j=8 i=2<br><br>000 15 99 | j=8 i=3<br><br>000 23 99 | j=8 i=4<br><br>000 31 99 |
| j=7 i=1<br><br>000 06 99 | j=7 i=2<br><br>000 14 99 | j=7 i=3<br><br>000 22 99 | j=7 i=4<br><br>000 30 99 |
| j=6 i=1<br><br>000 05 99 | j=6 i=2<br><br>000 13 99 | j=6 i=3<br><br>000 21 99 | j=6 i=4<br><br>000 29 99 |
| j=5 i=1<br><br>000 04 99 | j=5 i=2<br><br>000 12 99 | j=5 i=3<br><br>000 20 99 | j=5 i=4<br><br>000 28 99 |
| j=4 i=1<br><br>000 03 99 | j=4 i=2<br><br>000 11 99 | j=4 i=3<br><br>000 19 99 | j=4 i=4<br><br>000 27 99 |
| j=3 i=1<br><br>000 02 99 | j=3 i=2<br><br>000 10 99 | j=3 i=3<br><br>000 18 99 | j=3 i=4<br><br>000 26 99 |
| j=2 i=1<br><br>000 01 99 | j=2 i=2<br><br>000 09 99 | j=2 i=3<br><br>000 17 99 | j=2 i=4<br><br>000 25 99 |
| j=1 i=1<br><br>000 00 99 | j=1 i=2<br><br>000 08 99 | j=1 i=3<br><br>000 16 99 | j=1 i=4<br><br>000 24 99 |
| last sheet of the first run of 100 sheets | | | |

| | | | |
|---|---|---|---|
| j=8 i=1<br><br>000 07 00 | j=8 i=2<br><br>000 15 00 | j=8 i=3<br><br>000 23 00 | j=8 i=4<br><br>000 31 00 |
| j=7 i=1<br><br>000 06 00 | j=7 i=2<br><br>000 *14* 00 | j=7 i=3<br><br>000 *22* 00 | j=7 i=4<br><br>000 *30* 00 |
| j=6 i=1<br><br>000 *05* 00 | j=6 i=2<br><br>000 *13* 00 | j=6 i=3<br><br>000 *21* 00 | j=6 i=4<br><br>000 *29* 00 |
| j=5 i=1<br><br>000 *04* 00 | j=5 i=2<br><br>000 *12* 00 | j=5 i=3<br><br>000 *20* 00 | j=5 i=4<br><br>000 *28* 00 |
| j=4 i=1<br><br>000*03*00 | j=4 i=2<br><br>000*11*00 | j=4 i=3<br><br>000*19*00 | j=4 i=4<br><br>000*27*00 |
| j=3 i=1<br><br>000*02*00 | j=3 i=2<br><br>000*10*00 | j=3 i=3<br><br>000*18*00 | j=3 i=4<br><br>000*26*00 |
| j=2 i=1<br><br>000*01*00 | j=2 i=2<br><br>000*09*00 | j=2 i=3<br><br>000*17*00 | j=2 i=4<br><br>000*25*00 |
| j=1 i=1<br><br>000*00*00 | j=1 i=2<br><br>000*08*00 | j=1 i=3<br><br>000*16*00 | j=1 i=4<br><br>000*24*00 |
| 1st sheet of the first run of 100 sheets m = 1 | | | |

Fig. 1

1st Run of 100 m = 1

| | | x | i | k | |
|---|---|---|---|---|---|
| | | 1 | 2 | 3 | 4 |
| n | 8 | 0000700..99 | 00001500..99 | 0002300..99 | 0003100..99 |
| | 7 | 0000600..99 | 00001400..99 | 0002200..99 | 0003000..99 |
| | 6 | 0000500..99 | 0001300..99 | 0002100..99 | 0002900..99 |
| j | 5 | 0000400..99 | 0001200..99 | 0002000..99 | 0002800..99 |
| | 4 | 0000300..99 | 0001100..99 | 0001900..99 | 0002700..99 |
| | 3 | 0000200..99 | 0001000..99 | 0001800..99 | 0002600..99 |
| | 2 | 0000100..99 | 0000900..99 | 0001700..99 | 0002500..99 |
| y | 1 | 0000000..99 | 0000800..99 | 0001600..99 | 0002400..99 |

Fig.2a

2nd Run of 100 m = 2

| | | x | i | k | |
|---|---|---|---|---|---|
| | | 1 | 2 | 3 | 4 |
| n | 8 | 0003900..99 | 0004700..99 | 0005500..99 | 0006300..99 |
| | 7 | 0003800..99 | 0004600..99 | 0005400..99 | 0006200..99 |
| | 6 | 0003700..99 | 0004500..99 | 0005300..99 | 0006100..99 |
| j | 5 | 0003600..99 | 0004400..99 | 0005200..99 | 0006000..99 |
| | 4 | 0003500..99 | 0004300..99 | 0005100..99 | 0005900..99 |
| | 3 | 0003400..99 | 0004200..99 | 0005000..99 | 0005800..99 |
| | 2 | 0003300..99 | 0004100..99 | 0004900..99 | 0005700..99 |
| y | 1 | 0003200..99 | 0004000..99 | 0004800..99 | 0005600..99 |

Fig.2b

3rd Run of 100 m = 3

| | | x | i | k | |
|---|---|---|---|---|---|
| | | 1 | 2 | 3 | 4 |
| n | 8 | 0007100..99 | 0007900..99 | 0008700..99 | 0009500..99 |
| | 7 | 0007000..99 | 0007800..99 | 0008600..99 | 0009400..99 |
| | 6 | 0006900..99 | 0007700..99 | 0008500..99 | 0009300..99 |
| j | 5 | 0006800..99 | 0007600..99 | 0008400..99 | 0009200..99 |
| | 4 | 0006700..99 | 0007500..99 | 0008300..99 | 0009100..99 |
| | 3 | 0006600..99 | 0007400..99 | 0008200..99 | 0009000..99 |
| | 2 | 0006500..99 | 0007300..99 | 0008100..99 | 0008900..99 |
| y | 1 | 0006400..99 | 0007200..99 | 0008000..99 | 0008800..99 |

Fig.2c

4th Run of 100 m= 4

| | | x | i | k | |
|---|---|---|---|---|---|
| | | 1 | 2 | 3 | 4 |
| n | 8 | 0010300..99 | 0011100..99 | 0011900..99 | 0012700..99 |
| | 7 | 0010200..99 | 0011000..99 | 0011800..99 | 0012600..99 |
| | 6 | 0010100..99 | 0010900..99 | 0011700..99 | 0012500..99 |
| j | 5 | 0010000 99 | 0010800..99 | 0011600..99 | 0012400..99 |
| | 4 | 0009900..99 | 0010700..99 | 0011500..99 | 0012300..99 |
| | 3 | 0009800..99 | 0010600..99 | 0011400..99 | 0012200..99 |
| | 2 | 0009700..99 | 0010500..99 | 0011300..99 | 0012100..99 |
| y | 1 | 0009600..99 | 0010400..99 | 0011200..99 | 0012000..99 |

Fig.2d

5th Run of 100 m= 5

| | | x | i | k | |
|---|---|---|---|---|---|
| | | 1 | 2 | 3 | 4 |
| n | 8 | 0013500..99 | 0014300..99 | 0015100..99 | 0015900..99 |
| | 7 | 0013400..99 | 0014200..99 | 0015000..99 | 0015800..99 |
| | 6 | 0013300..99 | 0014100..99 | 0014900..99 | 0015700..99 |
| j | 5 | 0013200..99 | 0014000..99 | 0014800..99 | 0015600..99 |
| | 4 | 0013100..99 | 0013900..99 | 0014700..99 | 0015500..99 |
| | 3 | 0013000..99 | 0013800..99 | 0014600..99 | 0015400..99 |
| | 2 | 0012900..99 | 0013700..99 | 0014500..99 | 0015300..99 |
| y | 1 | 0012800..99 | 0013600..99 | 0014400..99 | 0015200..99 |

Fig.2e

6th Run of 100 m= 6

| | | x | i | k | |
|---|---|---|---|---|---|
| | | 1 | 2 | 3 | 4 |
| n | 8 | 0016700..99 | 0017500..99 | 0018300..99 | 0019100..99 |
| | 7 | 0016600..99 | 0017400..99 | 0018200..99 | 0019000..99 |
| | 6 | 0016500..99 | 0017300..99 | 0018100..99 | 0018900..99 |
| j | 5 | 0016400..99 | 0017200..99 | 0018000..99 | 0018800..99 |
| | 4 | 0016300..99 | 0017100..99 | 0017900..99 | 0018700..99 |
| | 3 | 0016200..99 | 0017000..99 | 0017800..99 | 0018600..99 |
| | 2 | 0016100..99 | 0016900..99 | 0017700..99 | 0018500..99 |
| y | 1 | 0016000..99 | 0016800..99 | 0017600..99 | 0018400..99 |

Fig.2f

7th Run of 100 m= 7

| | x | i | | k | |
|---|---|---|---|---|---|
| | | 1 | 2 | 3 | 4 |
| n | 8 | 0019900..99 | 0020700..99 | 0021500..99 | 0022300..99 |
| | 7 | 0019800..99 | 0020600..99 | 0021400..99 | 0022200..99 |
| | 6 | 0019700..99 | 0020500..99 | 0021300..99 | 0022100..99 |
| j | 5 | 0019600..99 | 0020400..99 | 0021200..99 | 0022000..99 |
| | 4 | 0019500..99 | 0020300..99 | 0021100..99 | 0021900..99 |
| | 3 | 0019400..99 | 0020200..99 | 0021000..99 | 0021800..99 |
| | 2 | 0019300..99 | 0020100..99 | 0020900..99 | 0021700..99 |
| y | 1 | 0019200..99 | 0020000..99 | 0020800..99 | 0021600..99 |

Fig.2g

8th Run of 100 m= 8

| | x | i | | k | |
|---|---|---|---|---|---|
| | | 1 | 2 | 3 | 4 |
| n | 8 | 0023100..99 | 0023900..99 | 0024700..99 | 0025500..99 |
| | 7 | 0023000..99 | 0023800..99 | 0024600..99 | 0025400..99 |
| | 6 | 0022900..99 | 0023700..99 | 0024500..99 | 0025300..99 |
| j | 5 | 0022800..99 | 0023600..99 | 0024400..99 | 0025200..99 |
| | 4 | 0022700..99 | 0023500..99 | 0024300..99 | 0025100..99 |
| | 3 | 0022600..99 | 0023400..99 | 0024200..99 | 0025000..99 |
| | 2 | 0022500..99 | 0023300..99 | 0024100..99 | 0024900..99 |
| y | 1 | 0022400..99 | 0023200..99 | 0024000..99 | 0024800..99 |

Fig.2h

1st Run of 100 m = 1

| | | x | | l | | k |
|---|---|---|---|---|---|---|
| | | 1 | 2 | 3 | 4 | 5 |
| n | 9 | 0000800..99 | 0001700..99 | 0002600..99 | 0003500..99 | 0004400..99 |
| | 8 | 0000700..99 | 0001600..99 | 0002500..99 | 0003400..99 | 0004300..99 |
| | 7 | 0000600..99 | 0001500..99 | 0002400..99 | 0003300..99 | 0004200..99 |
| | 6 | 0000500..99 | 0001400..99 | 0002300..99 | 0003200..99 | 0004100..99 |
| j | 5 | 0000400..99 | 0001300..99 | 0002200..99 | 0003100..99 | 0004000..99 |
| | 4 | 0000300..99 | 0001200..99 | 0002100..99 | 0003000..99 | 0003900..99 |
| | 3 | 0000200..99 | 0001100..99 | 0002000..99 | 0002900..99 | 0003800..99 |
| | 2 | 0000100..99 | 0001000..99 | 0001900..99 | 0002800..99 | 0003700..99 |
| y | 1 | 0000000..99 | 0000900..99 | 0001800..99 | 0002700..99 | 0003600..99 |

Fig.3a

2ndRun of 100 m = 2

| | | x | | i | | k |
|---|---|---|---|---|---|---|
| | | 1 | 2 | 3 | 4 | 5 |
| n | 9 | 00005300..99 | 00006200..99 | 00007100..99 | 00008000..99 | 00008900..99 |
| | 8 | 00005200..99 | 00006100..99 | 00007000..99 | 00007900..99 | 00008800..99 |
| | 7 | 00005100..99 | 00006000..99 | 00006900..99 | 00007800..99 | 00008700..99 |
| | 6 | 00005000..99 | 00005900..99 | 00006800..99 | 00007700..99 | 00008600..99 |
| j | 5 | 00004900..99 | 00005800..99 | 00006700..99 | 00007600..99 | 00008500..99 |
| | 4 | 00004800..99 | 00005700..99 | 00006600..99 | 00007500..99 | 00008400..99 |
| | 3 | 00004700..99 | 00005600..99 | 00006500..99 | 00007400..99 | 00008300..99 |
| | 2 | 00004600..99 | 00005500..99 | 00006400..99 | 00007300..99 | 00008200..99 |
| y | 1 | 00004500..99 | 00005400..99 | 00006300..99 | 00007200..99 | 00008100..99 |

Fig.3b

3rdRun of 100 m = 3

| | | x | | i | | k |
|---|---|---|---|---|---|---|
| | | 1 | 2 | 3 | 4 | 5 |
| n | 9 | 00009800..99 | 000010700..99 | 00011600..99 | 00012500..99 | 00013400..99 |
| | 8 | 00009700..99 | 00010600..99 | 00011500..99 | 00012400..99 | 00013300..99 |
| | 7 | 00009600..99 | 00010500..99 | 00011400..99 | 00012300..99 | 00013200..99 |
| | 6 | 00009500..99 | 00010400..99 | 00011300..99 | 00012200..99 | 00013100..99 |
| j | 5 | 00009400..99 | 00010300..99 | 00011200..99 | 00012100..99 | 00013000..99 |
| | 4 | 00009300..99 | 00010200..99 | 00011100..99 | 00012000..99 | 00012900..99 |
| | 3 | 00009200..99 | 00010100..99 | 00011000..99 | 00011900..99 | 00012800..99 |
| | 2 | 00009100..99 | 00010000..99 | 00010900..99 | 00011800..99 | 00012700..99 |
| y | 1 | 00009000..99 | 0009900..99 | 00010800..99 | 00011700..99 | 00012600..99 |

Fig.3c

4th Run of 100 m = 4

| | | | | i | | k |
|---|---|---|---|---|---|---|
| | | 1 | 2 | 3 | 4 | 5 |
| n | 9 | 00014300..99 | 00015200..99 | 00016100..99 | 00017000..99 | 00017900..99 |
| | 8 | 00014200..99 | 00015100..99 | 00016000..99 | 00016900..99 | 00017800..99 |
| | 7 | 00014100..99 | 00015000..99 | 00015900..99 | 00016800..99 | 00017700..99 |
| | 6 | 00014000..99 | 00014900..99 | 00015800..99 | 00016700..99 | 00017600..99 |
| j | 5 | 00013900..99 | 00014800..99 | 00015700..99 | 00016600..99 | 00017500..99 |
| | 4 | 00013800..99 | 00014700..99 | 00015600..99 | 00016500..99 | 00017400..99 |
| | 3 | 00013700..99 | 00014600..99 | 00015500..99 | 00016400..99 | 00017300..99 |
| | 2 | 00013600..99 | 00014500..99 | 00015400..99 | 00016300..99 | 00017200..99 |
| y | 1 | 00013500..99 | 00014400..99 | 00015300..99 | 00016200..99 | 00017100..99 |

Fig.3d

5th Run of 100 m = 5

| | | x | | i | | k |
|---|---|---|---|---|---|---|
| | | 1 | 2 | 3 | 4 | 5 |
| n | 9 | 00018800..99 | 00019700..99 | 00020600..99 | 00021500..99 | 00022400..99 |
| | 8 | 00018700..99 | 00019600..99 | 00020500..99 | 00021400..99 | 00022300..99 |
| | 7 | 00018600..99 | 00019500..99 | 00020400..99 | 00021300..99 | 00022200..99 |
| | 6 | 00018500..99 | 00019400..99 | 00020300..99 | 00021200..99 | 00022100..99 |
| j | 5 | 00018400..99 | 00019300..99 | 00020200..99 | 00021100..99 | 00022000..99 |
| | 4 | 00018300..99 | 00019200..99 | 00020100..99 | 00021000..99 | 00021900..99 |
| | 3 | 00018200..99 | 00019100..99 | 00020000..99 | 00020900..99 | 00021800..99 |
| | 2 | 00018100..99 | 00019000..99 | 00019900..99 | 00020800..99 | 00021700..99 |
| y | 1 | 00018000..99 | 00018900..99 | 00019800..99 | 00020700..99 | 00021600..99 |

Fig.3e

Figure 4a

| layer m | 1 | x | | i | k |
|---|---|---|---|---|---|
| 200'000 | | 1 | 2 | 3 | 4 |
| n | 8 | 00199300..201 | 00198500..401 | 00197700..601 | 00196900..801 |
| | 7 | 00199400..301 | 00198600..501 | 00197800..701 | 00197000..901 |
| | 6 | 00199500..401 | 00198700..601 | 00197900..801 | 00197100..001 |
| j | 5 | 00199600..501 | 00198800..701 | 00198000..901 | 00197200..101 |
| | 4 | 00199700..601 | 00198900..801 | 00198100..001 | 00197300..201 |
| | 3 | 00199800..701 | 00199000..901 | 00198200..101 | 00197400..301 |
| | 2 | 00199900..801 | 00199100..001 | 00198300..201 | 00197500..401 |
| y | 1 | 00200000..901 | 00199200..101 | 00198400..301 | 00197600..501 |

| layer m | 2 | x | | i | k |
|---|---|---|---|---|---|
| 200'000 | | 1 | 2 | 3 | 4 |
| n | 8 | 00196100..001 | 00195300..201 | 00194500..401 | 00193700..601 |
| | 7 | 00196200..101 | 00195400..301 | 00194600..501 | 00193800..701 |
| | 6 | 00196300..201 | 00195500..401 | 00194700..601 | 00193900..801 |
| j | 5 | 00196400..301 | 00195600..501 | 00194800..701 | 00194000..901 |
| | 4 | 00196500..401 | 00195700..601 | 00194900..801 | 00194100..001 |
| | 3 | 00196600..501 | 00195800..701 | 00195000..901 | 00194200..101 |
| | 2 | 00196700..601 | 00195900..801 | 00195100..001 | 00194300..201 |
| y | 1 | 00196800..701 | 00196000..901 | 00195200..101 | 00194400..301 |

| layer | 3 | x | | i | k |
|---|---|---|---|---|---|
| 200'000 | | 1 | 2 | 3 | 4 |
| n | 8 | 00192900..801 | 00192100..001 | 00191300..201 | 00190500..401 |
| | 7 | 00193000..901 | 00192200..101 | 00191400..301 | 00190600..501 |
| | 6 | 00193100..001 | 00192300..201 | 00191500..401 | 00190700..601 |
| j | 5 | 00193200..101 | 00192400..301 | 00191600..501 | 00190800..701 |
| | 4 | 00193300..201 | 00192500..401 | 00191700..601 | 00190900..801 |
| | 3 | 00193400..301 | 00192600..501 | 00191800..701 | 00191000..901 |
| | 2 | 00193500..401 | 00192700..601 | 00191900..801 | 00191100..001 |
| y | 1 | 00193600..501 | 00192800..701 | 00192000..901 | 00191200..101 |

Figure 4b

| layer | 4 | x | i | k | |
|---|---|---|---|---|---|
| 200'000 | | 1 | 2 | 3 | 4 |
| n | 8 | 00189700..601 | 00188900..801 | 00188100..001 | 00187300..201 |
| | 7 | 00189800..701 | 00189000..901 | 00188200..101 | 00187400..301 |
| | 6 | 00189900..801 | 00189100..001 | 00188300..201 | 00187500..401 |
| j | 5 | 00190000..901 | 00189200..101 | 00188400..301 | 00187600..501 |
| | 4 | 00190100..001 | 00189300..201 | 00188500..401 | 00187700..601 |
| | 3 | 00190200..101 | 00189400..301 | 00188600..501 | 00187800..701 |
| | 2 | 00190300..201 | 00189500..401 | 00188700..601 | 00187900..801 |
| y | 1 | 00190400..301 | 00189600..501 | 00188800..701 | 00188000..901 |

| layer | 5 | x | i | k | |
|---|---|---|---|---|---|
| 200'000 | | 1 | 2 | 3 | 4 |
| n | 8 | 00186500..401 | 00185700..601 | 00184900..801 | 00184100..001 |
| | 7 | 00186600..501 | 00185800..701 | 00185000..901 | 00184200..101 |
| | 6 | 00186700..601 | 00185900..801 | 00185100..001 | 00184300..201 |
| j | 5 | 00186800..701 | 00186000..901 | 00185200..101 | 00184400..301 |
| | 4 | 00186900..801 | 00186100..001 | 00185300..201 | 00184500..401 |
| | 3 | 00187000..901 | 00186200..101 | 00185400..301 | 00184600..501 |
| | 2 | 00187100..001 | 00186300..201 | 00185500..401 | 00184700..601 |
| y | 1 | 00187200..101 | 00186400..301 | 00185600..501 | 00184800..701 |

| layer | 6 | x | i | k | |
|---|---|---|---|---|---|
| 200'000 | | 1 | 2 | 3 | 4 |
| n | 8 | 00183300..201 | 00182500..401 | 00181700..601 | 00180900..801 |
| | 7 | 00183400..301 | 00182600..501 | 00181800..701 | 00181000..901 |
| | 6 | 00183500..401 | 00182700..601 | 00181900..801 | 00181100..001 |
| j | 5 | 00183600..501 | 00182800..701 | 00182000..901 | 00181200..101 |
| | 4 | 00183700..601 | 00182900..801 | 00182100..001 | 00181300..201 |
| | 3 | 00183800..701 | 00183000..901 | 00182200..101 | 00181400..301 |
| | 2 | 00183900..801 | 00183100..001 | 00182300..201 | 00181500..401 |
| y | 1 | 00184000..901 | 00183200..101 | 00182400..301 | 00181600..501 |

Figure 4c

| layer | 7 | x | | i | k |
|---|---|---|---|---|---|
| *200'000* | | *1* | *2* | *3* | *4* |
| n | *8* | 00180100..001 | 00179300..201 | 00178500..401 | 00177700..601 |
| | *7* | 00180200..101 | 00179400..301 | 00178600..501 | 00177800..701 |
| | *6* | 00180300..201 | 00179500..401 | 00178700..601 | 00177900..801 |
| j | *5* | 00180400..301 | 00179600..501 | 00178800..701 | 00178000..901 |
| | *4* | 00180500..401 | 00179700..601 | 00178900..801 | 00178100..001 |
| | *3* | 00180600..501 | 00179800..701 | 00179000..901 | 00178200..101 |
| | *2* | 00180700..601 | 00179900..801 | 00179100..001 | 00178300..201 |
| y | *1* | 00180800..701 | 00180000..901 | 00179200..101 | 00178400..301 |

| layer | 8 | x | | i | k |
|---|---|---|---|---|---|
| *200'000* | | *1* | *2* | *3* | *4* |
| n | *8* | 00176900..801 | 00176100..001 | 00175300..201 | 00174500..401 |
| | *7* | 00177000..901 | 00176200..101 | 00175400..301 | 00174600..501 |
| | *6* | 00177100..001 | 00176300..201 | 00175500..401 | 00174700..601 |
| j | *5* | 00177200..101 | 00176400..301 | 00175600..501 | 00174800..701 |
| | *4* | 00177300..201 | 00176500..401 | 00175700..601 | 00174900..801 |
| | *3* | 00177400..301 | 00176600..501 | 00175800..701 | 00175000..901 |
| | *2* | 00177500..401 | 00176700..601 | 00175900..801 | 00175100..001 |
| y | *1* | 00177600..501 | 00176800..701 | 00176000..901 | 00175200..101 |

| layer | 63 | x | | i | k |
|---|---|---|---|---|---|
| *200'000* | | *1* | *2* | *3* | *4* |
| n | *8* | 00900..801 | 00100..001 | XXXXXXXXX | XXXXXXXXX |
| | *7* | 001000..901 | 00200..101 | XXXXXXXXX | XXXXXXXXX |
| | *6* | 001100..001 | 00300..201 | XXXXXXXXX | XXXXXXXXX |
| j | *5* | 001200..101 | 00400..301 | XXXXXXXXX | XXXXXXXXX |
| | *4* | 001300..201 | 00500..401 | XXXXXXXXX | XXXXXXXXX |
| | *3* | 001400..301 | 00600..501 | XXXXXXXXX | XXXXXXXXX |
| | *2* | 001500..401 | 00700..601 | XXXXXXXXX | XXXXXXXXX |
| y | *1* | 001600..501 | 00800..701 | XXXXXXXXX | XXXXXXXXX |

NUMBERING PROCESS AND NUMBERING BOX TO CARRY OUT THE PROCESS

FIELD OF THE INVENTION

The present invention concerns a numbering process for numbering objects, such as banknotes, securities, passports, ID cards and other similar objects arranged in lines and columns on sheets of substrate and a method for processing substrate using said process.

The present invention also concerns a numbering device or box for numbering objects, such as banknotes, securities, passports, ID cards and other similar objects arranged in lines and columns on sheets of substrate.

BACKGROUND OF THE INVENTION

In the art of printing machines for securities having the form of notes, such as banknotes, checks and other similar objects, an important feature which is printed on said objects is a serial number. For example, each banknote printed on a substrate, such as a sheet of paper, receives a unique combination of numbers and characters building the serial number of said note.

Many numbering processes have been developed in the art. For example, U.S. Pat. No. 4,677,910, the content of which is incorporated by reference in the present application, discloses a process and an apparatus for processing security paper prints arranged in lines and columns on a carrier in the form of paper webs or sheets. The print carriers pass, in succession, by a reading instrument which detects the positions of the defective notes identified by a mark and feeds the position to a computer for storage, a cancellation printer controlled by the computer which provides the defective notes with a cancellation print, and a numbering machine. The numbering mechanisms of this numbering machine are moved forward by the computer in such a way that always the satisfactory paper prints, placed in succession in any longitudinal row, are serially numbered, the spoilt notes being neglected. Subsequently, the printed carriers, having passed by another reading instrument, are cut into individual security papers or notes, the defective notes are separated out in a separation device and the remaining, serially numbered individual security notes are assembled to form bundles, each having a complete numerical sequence. In this way, a correct and complete numerical sequence of the security notes in the bundles is ensured, in spite of the separation of defective notes.

With securities usually printed in matrix format on a substrate, several problems arise when one wants to build packs of individual securities which are numbered with successive numbers. A first problem is due to the fact that each sheet of substrate has to be cut into individual notes. In order to maintain a proper production speed, it is in principle not possible to cut each note individually of each produced sheet of substrate, but preferably a run of sheets are piled up and cut together by appropriate cutting devices known in the art.

It has also been determined that a good compromise has been attained by working with piles of 100 sheets of substrate since this is an optimum size to be cut in a precise manner when the piled sheets are to be cut into individual notes.

Another problem one is faced with is the individual numbering of each produced object, such as security note. It is of course not possible to number each produced note once it has been cut with consecutive numbers until the completion of a so-called close set of numbers, usually comprising a million numbered notes in a particular series. Actually, the notes are numbered before being cut, i.e. when the sheet of substrate is still complete, the numbering being part of the printing process of the notes, rather than being carried out after the cutting operation. According to this method, another parameter that must be taken into account is the presence of misprints or defective notes on the substrate. Since all notes of the packs of notes are numbered consecutively, it is not reasonable to build packs of notes with defective notes, which have to be replaced later by correct notes with the same serial number. U.S. Pat. No. 4,677,910 discloses a solution to this problem, as indicated here above. In this patent however, the sheets of substrate are cut individually into individual notes: because of the presence of misprints, it is not possible to cut piles of sheets into piles of individual notes and the individual notes must be sorted out before being piled up to form bundles of notes with consecutive numerical sequences.

According to another process, the sheets comprising misprints are removed before the numbering operation and only sheets with no defective notes are numbered.

Another numbering process is disclosed in European patent application EP 0 598 679, the content of which is enclosed by reference in the present application. In this process, for each sheet comprising N impressions of notes arranged in transverse and longitudinal rows which is run through a numbering machine with N numbering units, the numbering comprising a closed set of numbers with W notes of value and the number of sheets amounting to a multiple of 100, the number of note prints N is divisible by 10 and on each sheet every 10 neighbouring note prints form a group of ten, which receive numbers of the same series of a thousand. Further, in each sequence of 100 successive sheets, the note prints lying respectively at the same note position, that is to say in the same transverse row and in the same longitudinal row, are numbered with the 100 successive numbers of a particular series of a hundred, and the ten note prints of a group of ten of each sheet are numbered with numbers of successive series of hundreds with the same ones and tens. Moreover, the note prints on all subsequent sequences of 100 sheets each are numbered with numbers of successive series of thousands with in each case the same ones, tens and hundreds for the note prints lying at the same note positions, so that the note prints of a sequence of 100 sheets belonging to one and the same group of ten receive the complete sequence of number of a particular series of thousand and the note prints of the following sequence of 100 sheets belonging to the same group of ten receive the complete sequence of numbers of the following series of a thousand, the note prints belonging to various groups of ten being numbered in such a way that the numbers of one group of ten differ from the numbers of another group of ten by an amount which is at least equal to W/Z, Z being the number of groups of ten of a sheet.

Another technical field which is involved in the process of numbering prints or objects arranged in lines and columns on a substrate is of course the numbering devices used to print the proper number on each individual note print. Two main categories exist for such devices, which usually comprise several numbering wheels or disks having the successive numbers or characters engraved in raised form on their circumference. The numbering wheels are either sequentially actuated, which means that such a numbering device is only able to print successive numbers, the wheels being displaced by one step in a fixed sequence, or freely actuated numbering wheels which are able to take any position in an independent fashion, thus being able to print any desired sequence of numbers.

The first category of numbering devices uses a simple mechanism which is only able to change numbers in a sequential order. The numbering wheel for the ones is mechanically coupled to the numbering wheel for the tens, so that the tens wheel is moved one step forward only when the ones wheel passes from the number 9 to the number 0. Similarly, the wheel for the hundreds moved one step forward only when the tens wheel and the ones wheel passes from the number 99 to the number 00 and so on. Such a numbering device is therefore unable to either skip a number or print any given number successively and only strict consecutive numbering processes may be carried out with this numbering device. These devices are known in the art, for example from U.S. Pat. No. 4,677,910.

The second category of numbering devices with freely adjustable numbering wheels is disclosed in U.S. Pat. No. 5,660,106, the content of which is incorporated by reference in the present application. This patent discloses numbering devices using an electromagnetic system to block the numbering wheels in the desired position for each numbering step of printed matter. Therefore, the disclosed fully automatically settable numbering unit has the advantage that selectively arbitrary, even non-sequential, numbers can be set at any time, allowing a skip of numbers in a sequence. For a detailed explanation of the functioning of these numbering units, reference is made to the entire disclosure of U.S. Pat. No. 5,660,106.

Such numbering devices are particularly useful in processes where numbers are skipped between notes numbered by the same numbering device or when the same number has to be printed on two or more successive notes. However, these numbering units also have the disadvantage that they are complicated with respect to sequential numbering devices, which are usually purely mechanical and also in that they become very warm due to their construction, according to which excessive amounts of energy are dissipated by friction.

Another category of hybrid numbering devices is for example disclosed in U.S. Pat. No. 4,677,910, mainly in FIGS. 6 and 6*a*, the corresponding description of these numbering devices being incorporated by reference in the present application. This numbering device overcomes the limitation of purely sequential numbering devices and allows changes in the sequence of numbers. The numbering device disclosed in this patent comprises six numbering wheels (see for example in FIG. 6*a*), i.e. from the right to the left, a wheel 21 for the ones digit, a wheel 22 for the tens digit, a wheel 23 for the hundreds digit, a wheel 24 for the thousands digit etc. All the wheels are mechanically coupled together to provide a pure sequential numbering, except for the wheel printing the ones digit which is kinematically independent from the others and moved by an electric motor. Due to the numbering process used in this patent, according to which notes which are printed on a substrate and arranged in a matrix made of lines and columns are numbered with consecutive numbers on the same sheet. Therefore, if a misprint is present on the sheet, two neighbouring notes, the misprinted one and the next note, receive the same serial number, the ones digit does not change. It is therefore necessary to skip one unit in the numbering process, that is to avoid to move the wheel corresponding to the ones digit. For this reason, this wheel is driven in an independent manner by a motor and is not moved when misprints are encountered during the numbering operation of a sheet.

There is therefore a need for simplified numbering processes and devices which are effective with respect to the different problems encountered in the field of numbering objects arranged in lines and columns on a substrate, i.e. the size of the substrate or piled substrate, the numbering process used to optimise the numbering operations and the numbering devices able to carry out the desired numbering process.

SUMMARY OF THE INVENTION

An aim of the invention is to provide an improved numbering method and an improved numbering device.

More specifically, an aim of the invention is to provide a numbering process which allows a simplified collating of numbered objects in order to form packs of said objects sequentially numbered.

Another aim of the invention is to provide a numbering device which is at the same time simple to fabricate but also capable to print serial numbers in the required sequence.

BRIEF DESCRIPTION OF THE DRAWINGS

Further characterizing features and advantages of the present invention will become apparent from the following detailed description, given by way of non-limitative examples in the case of security notes, such as banknotes arranged on sheets of substrate, such as paper, in columns and lines, said examples being illustrated by the accompanying drawings, in which FIG. 1 shows the first and the last sheet of a run of 100 sheets numbered upwards with the numbering process according to the invention.

FIG. 2*a* to 2*h* show the successive numbers printed on each note for consecutive runs of sheets.

FIG. 3*a* to 3*e* show the successive numbers printed on each note for consecutive runs of sheets, with notes arranged in five columns and nine lines.

FIGS. 4*a* to 4*c* shows the successive numbers printed in downward numbering.

DETAILED DESCRIPTION OF THE EMBODIMENTS

Figure 5:
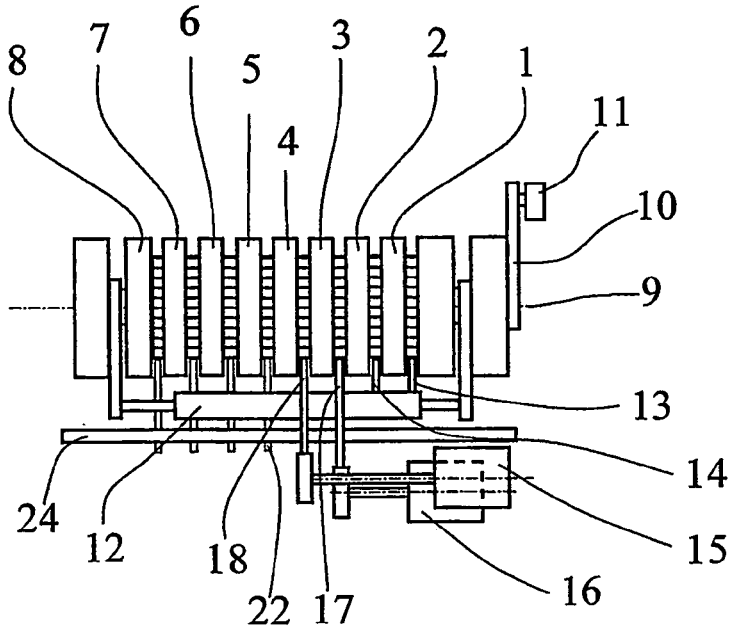
FIG. 5 shows a diagrammatic representation of a numbering device.

The process according to the invention is first described with reference to FIG. 1 in which, as a non-limitative example, one has represented a sheet of security paper on which notes, such as banknotes, have been printed in lines and columns in a matrix form. Each note carries a seven digit serial number, with (starting from the right) a ones digit, tens digit, hundred digits, thousands digit etc. Of course, more digits may be used, also in combination with letters and other alphanumeric characters. Usually, banknotes are printed in closed series of 1 million consecutively numbered notes, hence the example of seven digits serial numbers. Moreover, by convention, one defines that the lines are perpendicular to the direction of motion of the sheet and the columns are parallel to said direction. In the example of FIG. 1, the sheet comprises 4*8 notes (four columns and eight lines).

The formula used in the process according to the invention allows to define the start numbers for the hundreds and thousands digits to be printed on the first sheet of each run of 100 consecutive sheets for each printed note on the sheet, when numbering upwards.

The formula is the following: $Z=(j-1)+(i-1)*n+(m-1)*(k*n)$, whereby

Z is the start number of the hundreds and thousands digits of a given note position in a run of 100 notes j is the line position of the given note, i is the column position of the given note, n is the total number of lines on the sheet, m is the number of the run of 100 sheets (first run, second run etc.) and k is the number of columns on the sheet.

The collecting sequence of the finishing machine will then be i/j, i=1 . . . k, j=1 . . . n, starting from 1/1, 1/2, . . . 1/n, 2/1 . . . 2/n . . . k/n.

Accordingly, in this example, the number of digits p=7, k=4, n=8 and q=100 (run of 100 sheets), therefore s=2.

In the example of FIG. 1, each printed note contains, as a non limiting example, a seven digits serial number and the notes of successive sheets of a run of 100 sheets which are in the same position, that is in the same line and column, are numbered in a consecutive manner so that, once the 100 sheets have been numbered and are piled up, a given line and column of the pile contains 100 consecutively numbered notes. Further, the neighbouring line in the collecting sequence of the finishing machine in the same column contains 100 consecutively numbered notes with a numbering following directly the numbering of the preceding line so that when the run of 100 sheets is cut into piles of 100 individual notes, successive packs have a consecutive numbering.

This will be best understood with reference to FIG. 1 in which, by convention, the direction of movement of consecutive sheets is downwards, as indicated by the arrow. The first note of the first sheet is in the lower left side of said sheet and has a line position j=1 and a column position i=1 as indicated in FIG. 1. Being the first note, it receives the number 000 00 00. As explained above, since individual notes are consecutively numbered in the same line and column position to build a pile of 100 consecutively numbered notes when 100 sheets are piled up, the note receiving the number 000 00 01 is the note having the position j=1 and i=1 on the second sheet of a run of 100 sheets and similarly, the note in the same position on the third sheet of the run receives the number 000 00 02 etc. For the sake of clarity, not all 100 sheets of a run have been represented in FIG. 1 but only the first sheet and the last sheet are shown. Therefore, in line with the principle indicated above, the note in the position j=1 and i=1 of the last sheet of a run of 100 sheets receives the number 000 00 99. Once the 100 sheets of a run are piled up, the position j=1 and i=1 indeed contains 100 consecutively numbered notes, with the numbers 000 00 00 (first sheet), 000 00 01 (second sheet), 000 00 02 (third sheet) . . . 000 00 99 ($100^{th}$ sheet).

According to the convention explained above, the notes placed in the position j=2 and i=1 (second line, first column) receive the serial numbers following the serial number of the notes placed in position j=1 and i=1, therefore since the note in this position of the last sheet of a run of 100 has the number 000 00 99, the note in the position j=2 and i=1 of the first sheet of the run of 100 receives the serial number 000 01 00 as represented in FIG. 1. Accordingly, the note in this position on the last sheet of a run of 100 sheets thus receives the number 000 01 99 and so on for the next lines of the same column. Following this convention, the notes in position j=8 and i=1 receive the serial numbers 000 07 00 (first sheet) to 000 07 99 (last sheet) and the note carrying the next serial number 000 08 00 is in the position j=1 and i=2, i.e. first line of the second column of the first sheet. The same principle is applied for each column, that is the note following the note in position j=8 i=2 of the last sheet of a run of 10 sheets is in position j=1 i=3 of the first sheet of the run of 100 etc. This allows a collecting of bundles of individual notes which are consecutively numbered in a simple manner to build packs of notes, for example of 1000 notes, which are also consecutively numbered.

For the first sheet of a run of 100 sheets, the start numbers for the hundreds digit, the thousands digit and higher digits is determined by the formula indicated above.

For example in position j=1 and i=1 and the first run of 100 sheets (m=1), the calculation gives:

$$Z=(j-1)+(i-1)*n+(m-1)*(k*n)=(1-1)+(1-1)*8+(1-1)*(4*8)=0+0*8+0*32=0,$$ hence the number 000 00 00.

For example in position j=5 and i=1 of the first run (m=1), the calculation gives:

$$Z=(5-1)+(1-1)*8+(1-1)*(4*8)=4+0*8+0*32=4,$$ hence the number 000 04 00.

In another example for position j=4 and i=3 of the first run (m=1), the calculation gives:

$$Z=(4-1)+(3-1)*8+(1-1)*(4*8)=3+16+0*32=19,$$ hence the number 000 19 00.

Accordingly, all starting values of the hundreds and thousands digits for each note of the first sheet of a run of 100 are determined by this formula. Once the last note of a run of 100 sheets has been numbered then the first note of the next run has to receive the next consecutive serial number. In the example of FIG. 1, the last serial number given to a note is to the note in position j=8 and i=4, which receives the number 000 31 99. Therefore, the first number to be used on the first sheet at position j=1 and i=1 of the next run of 100 sheets should be 000 32 00.

As in example of FIG. 1, this serial number should be given to the note in position j=1 and i=1 of the second run of 100 sheets, since FIG. 1 represents the first run of 100 sheets.

According to the formula, the calculation gives the following result, wherein m=2 (second run of 100 sheets):

$$Z=(j-1)+(i-1)*n+(m-1)*(k*n)=(1-1)+(1-1)*8+(2-1)*(4*8)=0+0*8+1*32=32,$$ hence the number 000 32 00.

Accordingly, the number calculated corresponds exactly to the number indicated above for the hundreds and thousands digit, i.e. 32.

Examples of numbering sequences are given in detail in FIGS. 2*a* to 2*h*, for consecutive runs of 100 sheets comprising 4*8 notes arranged in four columns and eight lines.

FIG. 2*a* corresponds to FIG. 1 in that the sequence of the numbering for a run of 100 sheets is given in each note position, i.e. in position j=1 and i=1 000 00 00 to 000 00 99 (indicated by 000 00 00 . . . 99), corresponding to the numbers in the first sheet and the last sheet of a run of 100 sheets in FIG. 1. The first run of 100 sheets thus produces the notes numbered from 000 00 00 (note in position j=1 and i=1 of the first sheet) to 000 31 99 (note in position j=8 and i=4 of the last sheet of the run). The second run is represented in FIG. 2*b* and produces the notes numbered from 000 32 00 to 000 63 99.

The third run represented in FIG. 2*c* produces the notes numbered from 000 64 00 to 000 95 99.

The same applies to consecutive runs of 100 sheets which are represented in FIGS. 2*d* (fourth run), 2*e* (fifth run), 2*f* (sixth run), 2*g* (seventh run) and 2*h* (eight run) and the explanation given above for the first run applies in similar manner to these consecutive runs with the given formula being used to determine the hundreds and thousands digit of the first sheet of each run.

Other examples of calculation demonstrate the use of the formula. For example in run 4, column 1, the numbers skip from 000 99 99 (line 4) to 001 00 00 (line 5). Using the formula to calculate the number to be printed in position j=5 i=1 of the fourth run, on calculated:

$Z=(5-1)+(1-1)*8+(4-1)(8*4)=4+0*8+3*32=100$, hence the number 001 00 000 for this position on the first sheet of run 4.

Similarly, for run 7, in position j=1 and i=2, the calculation with the formulation gives 200 as a result, hence the number 002 00 00 for the note in this position on the first sheet of this run.

FIG. 3*a* to 3*e* shows the numbering series for runs of 100 sheets arranged in 5 columns and 9 lines. FIG. 3*a* indicates the numbers from 000 00 00 to 000 44 99, FIG. 3*b* from 000 45 00 to 000 89 99, FIG. 3*c* from 000 90 00 to 001 34 99, FIG. 3*d* from 001 35 00 to 001 79 99 and FIG. 3*e* from 001 80 00 to 002 24 99.

Again, as with FIGS. 1 and 2*a* to 2*h*, the numbers used in the digit corresponding to the hundred digits and higher digits for each note of the first sheet of each run of 100 are calculated with the above mentioned formula.

For example, position j=1 and i=5 in the first run (m=1) gives the following value for Z:

$Z=(1-1)+(5-1)*9+(1-1)*(5*9)=4*9=36$, hence the serial number 000 36 00.

Another example for position j=2 i=2 in run 3 (m=3), Z has the following value:

$Z=(2-1)+(2-1)*9+(3-1)*5*9=1+9+2*45=100$, hence the serial number 001 00 00.

All the start values for numbering the first sheet of each run of 100 sheets are accordingly easy to calculate with a simple algorithm and may be programmed well in advance of each run, on a computer for example, once the number of notes per sheet is known.

Due to the specific algorithm used to number the notes on the sheets of substrate, it is not possible to use conventional numbering devices. Indeed, only within a run of 100 sheets the notes of a particular note position on the sheet are consecutively numbered. For example, in position j=1 and i=1, the serial numbers to be printed are on each sheet of the first run of 100 sheets is, as explained above, 000 00 00 to 000 00 99 (see FIG. 1 or 2*a* for example). There is only for the ones digit and the tens digit a serial numbering in consecutive sequence.

Once the first run of 100 sheets has been numbered, the next number to be printed on the first sheet of the second run of 100 sheets in the position j=1 and i=1 is not 000 01 00 (next consecutive number following 000 00 99) but 000 32 00 (see FIG. 2*b*). It is therefore necessary to be able to skip from 000 00 99 to 000 32 00. For the ones and tens digit, there is fact no skip since 00 follows immediately 99 but the hundreds digit, the thousands digit must skip from 00 to 32 in this position of the sheet. The same problem applies to all note positions in which, as shown is FIGS. 2*a* to 2*h*, a skip takes place at least for the hundreds and the thousands digits after each run of 100 sheets, such skip occurring for each new run of 100 sheets.

For a downwards numbering, a similar formula can be used and the explanation given above for the upwards numbering apply mutatis mutandis. The formula is: $Z=D/10^s-((j-1)+(i-1)*n+(m-1)*k*n)$, whereby D is the serial number from which the downward numbering starts. This formula allows to set the initial number to be printed on the first substrate to be numbered.

FIGS. 4*a* to 4*c* show an example of a downward numbering for successive layers using said formula for the determination of the start numbers of a run of 100 sheets (S=2) with numbers containing 8 digits (P=8). In this example, the downward numbering starts from number 200,000 (D=200,000). In FIG. 4*a*, the numbering sequence for runs m=1 to m=3 is disclosed with numbers 00200000 (m=1, j=1, i=1) to 00190401 (m=3, j=8, i=4); in FIG. 4*b*, the numbering sequence for runs m=4 to m=6 is disclosed with numbers 00190400 (m=4, j=1, i=1) to 00180801 (m=6, j=8, i=4); and on FIG. 4*c*, the numbering sequence for runs m=7, m=8 and m=63 is disclosed with numbers 00180800 (m=7, j=1, i=1) to 00174401 (m=8, j=8, i=4) and on layer 63 00001600 (j=1, i=1) to 00000001 (j=8, i=2). As can be seen, the sequence is completed in run 63, in column 2, row 8. This is logical since, in the configuration disclosed of 32 objects per substrate, each run of 100 substrates gives 3'200 numbered objects. Sixty-two runs produce 198,400 numbered objects (62*3,200) and to obtain 200,000 numbered objects, it is necessary to number 200,000−198,400=1,600 objects in the 63rd run. Since a run produces 3,200 objects, half a run is sufficient to produce the remaining objects.

As indicated above, it is necessary to use numbering boxes which are able to skip numbers in order to follow the chosen numbering process. U.S. Pat. No. 5,660,106, for example, which has been cited in the present application, discloses such a freely programmable numbering device able to print any given number, even non sequential numbers.

However, this numbering device is complicated to fabricate, thus expensive, has a tendency to produce heat and is rather slow when changing numbers due to its complicated mechanism. Accordingly, there is a need to develop a simpler numbering box able to carry out the numbering process according to the invention which fast, accurate and reliable.

The numbering device according to the invention comprises a hybrid construction combining at least two different actuating techniques, wherein the wheels used for the ones digit and the tens digit are linked and actuated as a sequential numbering device, i.e. a purely mechanical numbering unit and at least the wheels for the hundreds digit and thousands digit are actuated in a totally independent manner, for example by dedicated motors, to allow the skip of numbers.

Further higher digits numbered by wheels 5, 6, 7 and 8 (ten thousands, hundred thousands, million . . . ) may be moved sequentially by a mechanical system, which will be actuated in a similar manner to the ones and tens digits.

Indeed, as seen in the examples disclosed above, it is sufficient to have only the wheel for the ones and the tens digits actuated in a purely sequential manner since these digits are always in a consecutive sequence (00 to 99) for successive sheets being numbered. This is particularly advantageous because these two digits are changing for each sheet and a mechanical actuating mechanism is more reliable and faster than the mechanism used in freely programmable numbering devices as disclosed in U.S. Pat. No. 5,660,106. The digits for the hundreds, thousands and higher do not change for each sheet numbered and skip numbers as disclosed above and explained with reference to the examples in FIGS. 1, 2*a* to 2*h* and 3*a* to 3*e*, therefore freely programmable mechanisms are necessary to move the corresponding numbering wheels and the actuating mechanisms will only be active when digits 4 and 5 change, which is every 100 sheets.

An embodiment of a numbering device according to the invention is described with reference to FIGS. 5 to 8.

With reference to FIG. 5, the principle of a numbering device is explained, firstly for a mechanical sequential numbering, i.e. for the ones digit and tens digit. The numbering device comprises seven numbering wheels 1 to 7, that is a wheel 1 for the ones, a wheel 2 for the tens, a wheel 3 for the hundreds etc. Preferably, all wheels are mounted in a frame 8 so as to be rotatable around a common axis 9. Wheels 1 and 2 are kinematically linked to each other in a manner known in the art, for example in U.S. Pat. No. 4,677,910. A forward motion lever 10 known per se which is used for the forward movement of the numbering wheels 1, 2. The lever 10 is rotatable around the axis 9 and carries, at one end an actuating roll 11 and, at the other end, a catch carrier 12 with operating catches 13, so-called fore-catchers. The catch carrier 12 with the operating catches 13, is supported rotatably about the axis 9 on the respective arm of the forward motion lever 10. The catches 13 are prestressed by a spring 50 in such a way that they are pressed in the direction of the indentations fixed at the side of the numbering wheels 1, 2. The depth of the tooth gaps of the various indentations of the numbering wheels 1, 2 and the length of the associated operating catches 13 are designed and dimensioned in a known manner in such a way that the operating catch 13 associated with the ones numbering wheel 1 always engages in the indentations of that numbering wheel 1, but that the operating catch 13 associated with the tens numbering wheel 2 can engage the indentations of the wheel 2 only if the ones numbering wheel is set to the number 0 in a downwards numbering process.

For further explanations regarding the functioning of a mechanical numbering device, reference is made to U.S. Pat. No. 4,677,910, in particular column 4, line 54 to column 5, line 65, column 11, line 16 to column 12, line 31, which passages are incorporated by reference in the present application.

Figure 7:
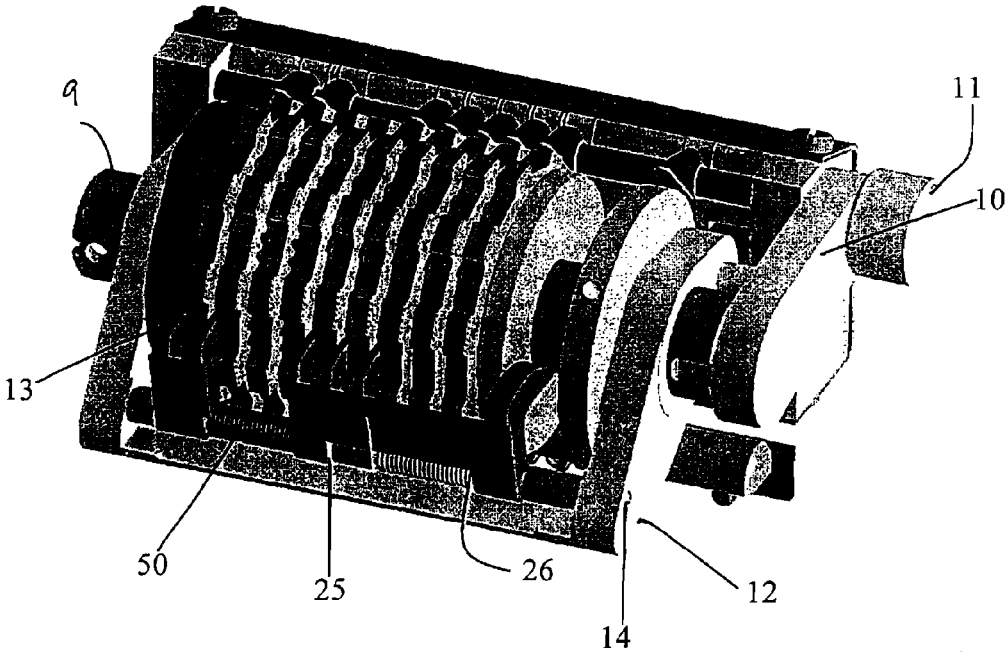

Then, as shown schematically in FIG. 5, the wheel 3 for the hundreds digits and the wheel 4 for the thousands digit are actuated in an independent manner, for example by motors 15 and 16, through pinions 17, 18 (see FIG. 7). This allows both wheels 3 and 4 to be moved quickly to any desired number, hence a skipping of the numbering sequence printed by the numbering device can be programmed. The principle of an independent actuating motor for a numbering wheel has been disclosed in U.S. Pat. No. 4,677,910, and reference is made to this patent for detailed explanations of functioning. Preferably, the motors are operated automatically by a computer device (not shown) in which the numbering sequence has been programmed/calculated for given runs of sheets. The skips in the numbering sequences are thus known and can be applied to the numbering devices of a numbering machine during the numbering process.

The actuating mechanism of the numbering wheels 6 to 8 etc. corresponding to the ten thousands, hundred thousands and higher digits (if any) is also preferably done mechanically in sequence. However, it is only actuated when the algorithm requires to increment the ten thousands and subsequently the hundred thousands and higher digits.

Figure 6:
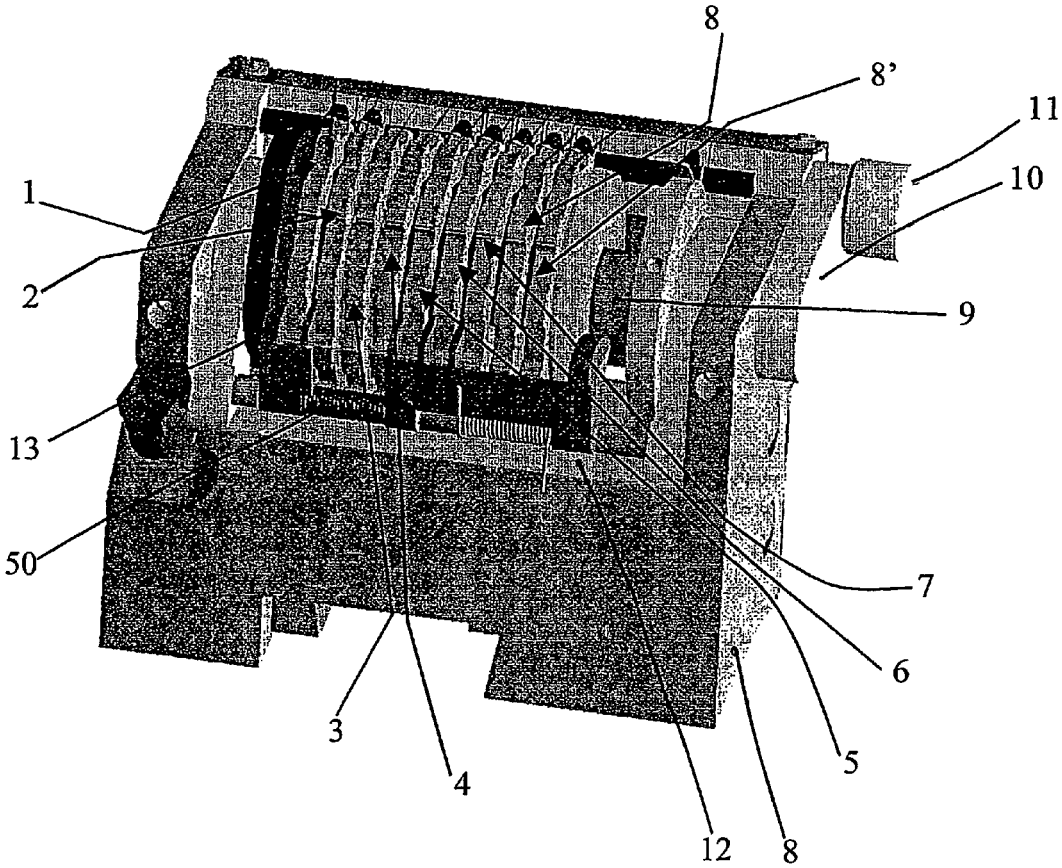
FIGS. 6 to 8 show a numbering device according to the invention in perspective view.
Figure 8:
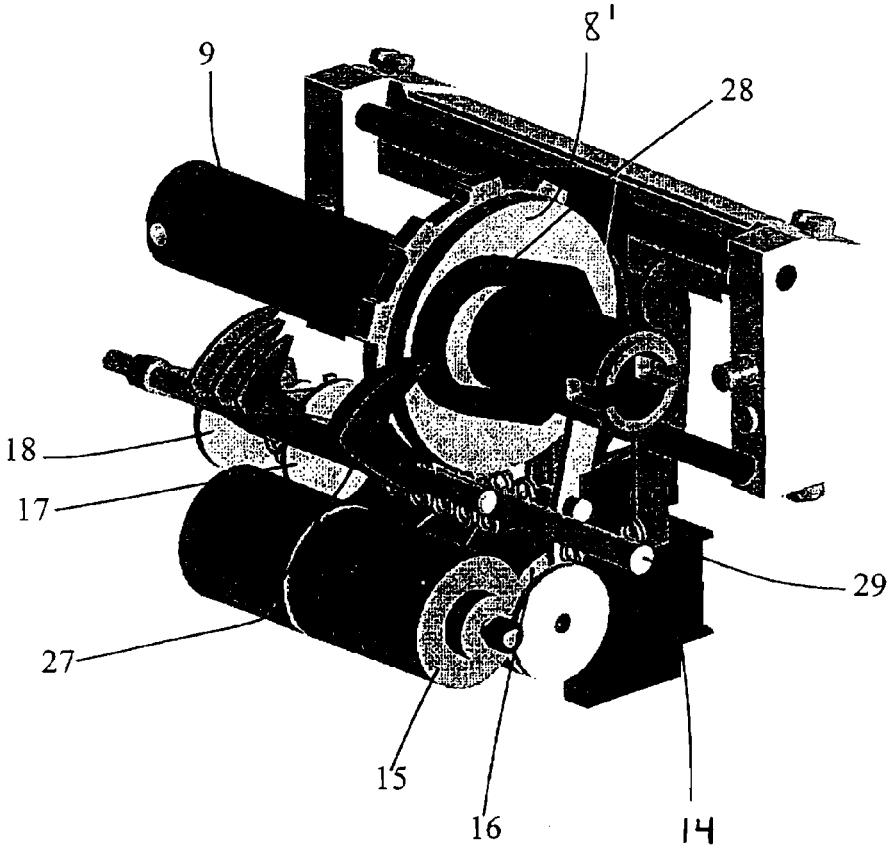

With reference to FIG. 6 to 8 an example of an actuating mechanism for wheels 5 to 7 is described in a numbering device according to the invention. The numbering devices comprises nine wheels (wheels 1 to 8 and wheel 8'), wheel 8' being for example useful to print a prefix to the number printed by wheels 1 to 8. The actuating mechanism comprises the catch carrier 12 which carries additional, independent catches 25, said carrier 12 being supported rotably about axis 9. The catches 25 are rotably fixed to the catch carrier 12 by an axis 14 and prestressed by spring 26 in such a way that they are pressed into the direction of the indentations fixed at the side of the numbering wheels 5, 6, 7. Those catches 25 will only actuate, when a steering catch 27 is freed by the actuation cam 28. The actuation cam 28 is rotated by an electromagnetic actuator 29, which increments through its actuation the digits 5, 6, 7 according to the algorithm of the layer start numbers. This system is principally similar to the mechanical arrangements as for wheels 1 and 2. The difference resides in its actuating by catches 25 only when mechanically freed.

The numbering device according to the invention comprises three stages: a purely mechanical stage which is the most reliable mechanism for ones and tens digits changing all the time, a motor driven stage for hundreds and thousands which is also fast for digits changing not all the time but which skip numbers, and an electromagnetic stage for higher digits which change consecutively in numerical sequence at lesser frequency.

A numbering device according to the present invention builds an optimal solution between complexity and reliability of the principle of the systems used to actuate the numbering wheels, and also allows the particular numbering method to be carried out in an effective manner.

From the numbering processes disclosed, a method for processing a substrate in the form of sheets or web can be implemented. In this method of processing, each sheet or each repetitive length of web contains objects arranged in k columns and n rows, said objects being numbered with a number containing p digits, comprising digits 1 to s, s+1 to r and r+1 to p. Piles of q sheets or of q repeat length of web are transformed into individual sheets and formed and processed into packs of individual objects by cutting said rows and said columns, whereby q is dividable with an even result by $10^s$, the packs resulting from the sequential cutting of successive piles forms a continuous flow of objects sequentially numbered by the formula disclosed for upwards or downwards numbering. As indicated above, in the finishing machine, once the runs of sheets, or of piles of web cut into sheets, have been cut successive piles, the collecting sequence is preferably i/j, i=1 . . . k, j=1 . . . n, starting from 1/1, 1/2, . . . 1/n, 2/1 . . . 2/n . . . k/n. The piles made of the successive lines of the first column are collected, then the lines of the second column etc.

The embodiments of the invention are given by way of example only and are not to be considered as limitations to the scope of the claims.

Further, the examples described in the present application have been mainly directed to security notes arranged on a sheet of substrate, such as paper. It is of course understood that the invention is not limited to security notes but is applicable to all objects receiving a serial number which are arranged in rows and columns on successive substrates entering a numbering machine.

The invention claimed is:

1. A process for numbering objects that are arranged in k columns and n rows on a substrate, the objects receiving a serial number with p digits, composed of digits 1 to s, s+1 to r and r+1 to p, the process comprising steps of:

for each first substrate of a run of $10^s$ successive substrates, calculating a start value Z for digit s+1 to digit r of the serial number with the formula:

$$Z=(j-1)+(i-1)*n+(m-1)*(k*n),$$

wherein k*n is smaller than $10^s$, s is smaller than p, j identifies a line of the object, i identifies a column of the object and m identifies a run of $10^s$ successive substrates; and sequentially numbering the objects.

2. A process for downwardly numbering objects that are arranged in k columns and n rows on a substrate, the objects receiving a serial number with p digits, composed of digits 1 to s, s+1 to r and r+1 to p, the process comprising steps of:

for each first substrate of a run of $10^s$ successive substrates, calculating a start value Z for digit s+1 to digit r of the serial number with the formula:

$$Z=D/10^s-((j-1)+(i-1)*n+(m-1)*k*n),$$

wherein D is a serial number from which downward numbering starts, k*n is smaller than $10^s$, s is smaller than p, j identifies a line of the object, i identifies a column of the object and m identifies a run of $10^s$ successive substrates; and sequentially numbering the objects.

3. A process for processing piles of substrates each containing objects that are arranged in k columns and n rows, the objects receiving a serial number with p digits, composed of digits 1 to s, s+1 to r and r+1 to p, the process comprising steps of:

for each first substrate of a run of $10^s$ successive substrates, calculating a start value Z for digit s+1 to digit r of the serial number with the formula:

$$Z=(j-1)+(i-1)*n+(m-1)*(k*n),$$

wherein k*n is smaller than $10^s$, s is smaller than p, j identifies a line of the object, i identifies a column of the object and m identifies a run of $10^s$ successive substrates;

sequentially numbering the objects;

forming piles of q substrates, wherein q is divisible by $10^s$ with an even result; and cutting each pile of q substrate along said rows and said columns to form packs of individual objects which are sequentially numbered.

4. The process of claim 3, wherein the piles of q substrates are constituted of q sheets of sequentially numbered objects or q repeat lengths of web transformed into sheets of sequentially numbered objects.

5. A process for processing piles of substrates each containing objects that are arranged in k columns and n rows, the objects receiving a serial number with p digits, composed of digits 1 to s, s+1 to r and r+1 to p, the process comprising steps of:

for each first substrate of a run of $10^s$ successive substrates, calculating a start value Z for digit s+1 to digit r of the serial number with the formula:

$$Z=D/10^s-((\mathrm{i}-1)+(i-1)*n+(m-1)*k*n),$$

wherein D is a serial number from which downward numbering starts, k*n is smaller than $10^s$, s is smaller than p, j identifies a line of the object, i identifies a column of the object and m identifies a run of $10^s$ successive substrates;

sequentially numbering the objects;

forming piles of q substrates, wherein q is divisible by $10^s$ with an even result; and cutting each pile of q substrate along said rows and said columns to form packs of individual objects which are sequentially numbered.

6. The process of claim 5, wherein the piles of q substrates are constituted of q sheets of sequentially numbered objects or q repeat lengths of web transformed into sheets of sequentially numbered objects.

7. A numbering box for typographic numbering of substrates each carrying k*n items to be numbered, said numbering box being adapted to print the items with serial numbers having p digits, the serial number comprising digits 1 to s, s+1 to r and r+1 to p; the numbering box comprising:

sequential actuation means for digits 1 to s, where 10 is smaller or equal to q, wherein q is a number of successively numbered substrates to be collated and processed into piles of q substrates;

individually settable actuation means for digits s+1 to r, where a maximum number printable by digits 1 to s and s+1 to r is smaller or equal to k*n*q; and sequential actuation means for digits r+1 to p.

8. The numbering box of claim 7, comprising corresponding numbering wheels for printing each of the p digits.

9. The numbering box of claim 7, wherein the sequential actuation means for digits 1 to s comprise mechanical actuation means.

10. The numbering box of claim 7, wherein the individually settable actuation means for digits s+1 to r comprise independent drive motors.

11. The numbering box of claim 7, wherein the sequential actuations means for digits r+1 to p comprise electromechanical initiation means.

12. A numbering machine for numbering banknotes, securities, passports and other similar objects placed on a substrate, the numbering machine comprising the numbering box of claim 7.

13. A numbering machine for numbering banknotes, securities, passports and other similar objects placed on a substrate, the numbering machine comprising the numbering box of claim 8.

14. A numbering machine for numbering banknotes, securities, passports and other similar objects placed on a substrate, the numbering machine comprising the numbering box of claim 9.

15. A numbering machine for numbering banknotes, securities, passports and other similar objects placed on a substrate, the numbering machine comprising the numbering box of claim 10.

16. A numbering machine for numbering banknotes, securities, passports and other similar objects placed on a substrate, the numbering machine comprising the numbering box of claim 11.

* * * * *

UNITED STATES PATENT AND TRADEMARK OFFICE

CERTIFICATE OF CORRECTION

PATENT NO. : 7,216,583 B2
APPLICATION NO. : 10/524337
DATED : May 15, 2007
INVENTOR(S) : Johannes Georg Schaede It is certified that error appears in the above-identified patent and that said Letters Patent is hereby corrected as shown below:

Column 7
Line 14, delete "001 00 000" and insert therefor -- 001 00 00 --.

Column 11
Line 58, delete "$Z = D/10^S - ((i-1) + (i-1)^*n + (m-1)^*k^*n)$," and
insert therefor -- $Z = D/10^S - ((j-1) + (i-1)^*n + (m-1)^*k^*n)$, --.

Signed and Sealed this

Fourth Day of December, 2007

JON W. DUDAS
*Director of the United States Patent and Trademark Office*